US007137205B2

(12) United States Patent
Royle

(10) Patent No.: US 7,137,205 B2
(45) **Date of Patent: *Nov. 21, 2006**

(54) LINKAGE MECHANISM PROVIDING A VIRTUAL PIVOT AXIS FOR RAZOR APPARATUS WITH PIVOTAL HEAD

(75) Inventor: Terence Royle, Basigstoke (GB)

(73) Assignee: The Gillette Company, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/089,531

(22) Filed: Mar. 24, 2005

(65) Prior Publication Data

US 2005/0198843 A1 Sep. 15, 2005

Related U.S. Application Data

(63) Continuation of application No. PCT/US03/31125, filed on Oct. 1, 2003.

(30) Foreign Application Priority Data

Oct. 1, 2002 (GB) ..... 0222742.9

(51) Int. Cl.
*B26B 21/52* (2006.01)
*B26B 21/22* (2006.01)

(52) U.S. Cl. ..... 30/527; 30/50

(58) Field of Classification Search ..... 30/43.9, 30/43.91, 43.92, 527, 50; 74/520; 403/322.1
See application file for complete search history.

(56) References Cited

U.S. PATENT DOCUMENTS 3,935,639 A 2/1976 Terry et al.
4,797,997 A 1/1989 Packham et al.
5,159,755 A 11/1992 Jestädt et al.
5,535,578 A 7/1996 Honey
5,704,126 A 1/1998 Franke et al.
5,787,593 A 8/1998 Althaus
5,953,824 A 9/1999 Ferraro et al.

(Continued)

FOREIGN PATENT DOCUMENTS

GB 2 266 070 A 10/1993

(Continued)

*Primary Examiner*—Hwei-Siu C. Payer
(74) *Attorney, Agent, or Firm*—Fish & Richardson P.C.

(57) ABSTRACT

A linkage mechanism for a razor having a head (1) carrying at least one razor blade mounted for a large extent of rocking about a virtual axis while being packaged within a slender handle envelope. The virtual pivot axis remains nearly static during pivoting. The linkage mechanism is attached to a handle (2) and has five links, which include a pair of spaced support arms (4, 5) pivoted to the cartridge (1) at first and second pivot axes (11, 12), the first and second pivot axes being spaced apart by a first distance; a first transverse link member (6) pivoted on the body (2) for rotation about a third axis (17) and being pivoted on each of the support arms (4, 5), at fourth and fifth pivot axes (15, 16) spaced apart by a second distance less than the first distance, and second and third transverse link members (7, 9) pivoted on the handle (2) at respective first ends thereof and being pivoted on respective second ends thereof to respective first ends thereof and being pivoted on respective second ends thereof to respective ones of the support arms (4, 5) at sixth and seventh pivot axes (13, 14) spaced apart by a third distance, said first, second, third, fourth, fifth, sixth and seventh axes being mutually parallel.

25 Claims, 13 Drawing Sheets

U.S. PATENT DOCUMENTS 6,052,904 A * 4/2000 Wetzel et al. ..... 30/43.92
6,098,289 A 8/2000 Wetzel et al.
6,115,924 A 9/2000 Oldroyd

FOREIGN PATENT DOCUMENTS

WO 93/12916 7/1993

* cited by examiner

PRIOR ART

LINKAGE MECHANISM PROVIDING A VIRTUAL PIVOT AXIS FOR RAZOR APPARATUS WITH PIVOTAL HEAD

This application is a continuation of copending International Application PCT/US03/31125 filed on Oct. 1, 2003, which designated the U.S., claims the benefit thereof and incorporates the same by reference.

Four bar linkages have been proposed to generate a virtual pivot axis and/or a side-to-side swivel axis in wet razors as in U.S. Pat. No. 6,115,924 (Oldroyd). Reference may also be made to U.S. Pat. No. 3,935,639 (Terry et al.) which discloses a four bar box-like structure arranged parallel to the longitudinal axis of the cutting head of a wet razor.

Other four-bar linkages in wet razors are known from U.S. Pat. No. 5,535,518 (Althaus), which purports to describe a parallelogram linkage in which each of two transverse links can buckle at a bend joint to unload a wet razor cartridge, and from U.S. Pat. No. 5,953,824 (Ferraro et al.), which discloses a linkage whose longitudinal arms have slots which are cammed by motion relative to fixed pins on the housing as the base transverse link rocks from side to side, in order allegedly to maintain a relatively constant distance between the razor head mounting pins.

Dry shavers having rockable heads are known. The rocking of the shaver head facilitates good contact between the shaver head and the user's skin during shaving.

WO 93/12916 (U.S. Pat. No. 6,098,289 (Wetzel et al.)) discloses a dry shaver having a head rockably mounted on a shaver body by means of first and second linkage mechanisms at respective ends of the head. Each linkage mechanism comprises a pair of transverse link members and a pair of vertical link arms pivotally mounted on the head and depending therefrom. Each arm is mounted on the shaver body by means of the transverse link members pivotably attached to the link arms at respective ends and to the shaver body at a central pivot axis lying in a common plane of symmetry of the first and second linkage mechanisms. The resulting four-bar linkage permits the head to rock about a virtual pivot axis located above its points of physical attachment to the link arms. This arrangement is a symmetric parallelogram, with the congruent pivot locations all lying in parallel lines.

Further linkage mechanisms of this type are described in U.S. Pat. Nos. 5,704,126 (Franke et al.), Pat. No. 5,159,755 (Jestaädt et al.) and Pat. No. 4,797,997 (Packham et al.).

It is known in the field of dry shavers, e.g. in those distributed widely in the United States by the company Braun under the trade designations "Flex Integral" or "Synchro", to have the shaving head mounted on a pin bearing defining a pivot axis about which the head travels in an arc of about +/−24 degrees about a rest position.

As mentioned above, an advantage of the four bar linkage mechanism of the type known from U.S. Pat. Nos. 6,098,289 and 6,115,924 is that, as described in more detail hereinafter, a virtual pivot centre may be produced well above the points of attachment of the vertical side members to the shaving head. In fact, the virtual pivot may be located on, above or even below skin level, in dependence upon the height of the transverse link members, typically in the form of pivoting triangles or bell crank links. This may be achieved without the need for a physical upper pivot location. However, a disadvantage of the mechanism is that the two vertical side members have to be arranged essentially parallel to the vertical plane of symmetry of the mechanism. In other words, the three points of attachment of each arm to, respectively, the rocking head, the first transverse link member and the second transverse link member lie on a straight line parallel to the plane of symmetry. Applicant has recognized that the resulting mechanism is relatively bulky and cannot be accommodated in a slim handle.

According to one aspect of the invention, there is provided a linkage mechanism for a shaving appliance having a cartridge carrying at least one blade and mounted on the appliance handle for rocking about a virtual axis generated by the linkage, said linkage mechanism mounted on a handle and comprising: a pair of spaced support arms for pivotable attachment to the cartridge at first and second pivot axes, said first and second pivot axes being spaced by a first distance; a first transverse link member pivotably mounted on said handle for rotation about a third axis and being pivotably attached to each of said support arms at fourth and fifth pivot axes spaced by a second distance less than the first distance; and second and third transverse link members pivotably mounted on the handle at respective first ends thereof and being pivotably attached at respective second ends thereof to respective ones of said support arms at sixth and seventh pivot axes, said first, second, third, fourth, fifth, sixth and seventh axes being mutually parallel.

A particularly compact arrangement is achieved when said sixth and seventh pivot axes are spaced by a third distance less than said first distance. Here, some further possibilities exist: either the third distance is less than the second distance, or vice versa. Also, this third distance could be of equal magnitude as the second distance.

Ergonomic design freedom is maximized when said respective first ends of the second and third transverse link members are pivotally mounted on the handle at eighth and ninth pivot axes which are spaced apart, and parallel to said first and second axes (see e.g. FIG. 12). Vertical compactness is optimized when a plane perpendicular to said parallel axes intersects said third, eighth and ninth axes at spaced points forming an isosceles triangle. It is also possible for said eighth and ninth axes to be colinear, which may simplify construction by reducing the number of components. In a symmetrical arrangement, said third, eighth and ninth axes and said virtual axis all lie in a common plane.

Constructional simplicity is achieved when the distance between said first and sixth axes equals the distance between said second and seventh axes (see e.g. FIG. 2).

In certain circumstances, an asymmetric construction may be preferred, in which the distance between said first and sixth axes is greater than the distance between said second and seventh axes (see e.g. FIG. 6).

It is preferred that the distance between said first and fourth axes equals the distance between said second and fifth axes (see e.g. FIG. 2, FIG. 8).

Here a symmetrical arrangement may preferably be achieved when the distance between said first and sixth axes is less than the distance between said first and fourth axes (see e,g. FIG. 2, FIG. 9).

Alternatively, another compact arrangement is achieved when the distance between said first and sixth axes is greater than the distance between said first and fourth axes (see e.g. FIG. 15, FIG. 18). Although this will generally increase the vertical height of the mechanism, it may minimize the lateral width.

Other advantages of the present invention lie in the capacity of the linkage arrangement to permit a very large arc of rocking motion in proportion to the relatively slender handle or body in which the linkage is accommodated.

Preferably, there are first and second spaced linkage mechanisms supporting the cartridge According to another aspect of the invention, there is provided a linkage mechanism for carrying a razor cartridge which comprises a five-bar linkage pivotally supporting a cartridge for rotation relative to a handle about a virtual pivot axis. In a preferred embodiment, there are two spaced support arms which are pivotally connectable to a hair removal cartridge; a first common transverse link member pivotally mounted on the handle and pivotably attached to each of the support arms; and second and third stabilizing links pivotably mounted on the handle at respective first ends thereof and being pivotally attached at respective second ends thereof to respective ones of said support arms. In such an embodiment, the hair removal cartridge is not kinematically required as part of the "five-bar" linkage. When the second and third stabilizing links are pivoted at their respective first ends to the handle, these second and third links are movable relative to one another. In preferred embodiments the two spaced support arms are not parallel to one another.

According to another aspect of the invention, the razor cartridge itself kinematically forms one of the links of the five-bar linkage wherein the hair removal cartridge is pivotally supported for rotation relative to a handle about a virtual pivot axis. In such an embodiment, the five-bar linkage is determined by two spaced support arms which are pivotally connected to the cartridge; a first common transverse link member pivotally mounted on the handle and pivotably attached to each of the support arms; and at least one stabilizing link pivotably mounted on the handle at a first end thereof and pivotally attached at a respective second end thereof to one of said support arms. An additional transverse stabilizing arm may optionally be provided, for example to be more robust under load or to stabilize the support arms in the event the cartridge were detached.

According to a further aspect of the invention, there is provided a method of mounting a component, e.g. a razor cartridge for rocking about a virtual axis, the method comprising the following steps: pivotably attaching a pair of spaced support arms to the cartridge at first and second pivot axes, said first and second pivot axes being spaced by a first distance; pivotably mounting a first transverse link member on a handle for rotation about a third axis and pivotably attaching the first link member to each of said support arms, at fourth and fifth pivot axes spaced by a second distance less than the first distance; and pivotably mounting second and third transverse link members on the body at respective second ends thereof and pivotably attaching the second and third link members at respective second ends thereof to respective ones of said support arms at sixth and seventh pivot axes spaced by a third distance, said first to seventh axes being mutually parallel.

For a better understanding of the invention and to show how the same may be carried into effect, reference will now be made, by way of example, to the accompanying drawings.

Figure 28:
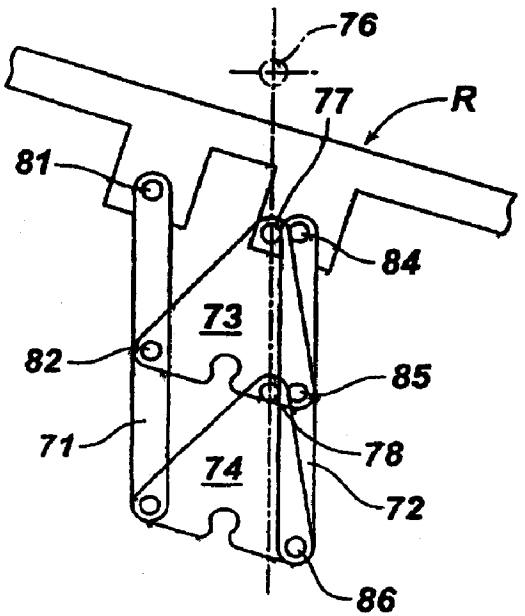
FIG. 28 is a diagrammatic side view of a prior art shaver cartridge mounted on a linkage mechanism to permit pivoting of the cartridge, with the cartridge shown in a pivoted position to one side.
Figure 29:
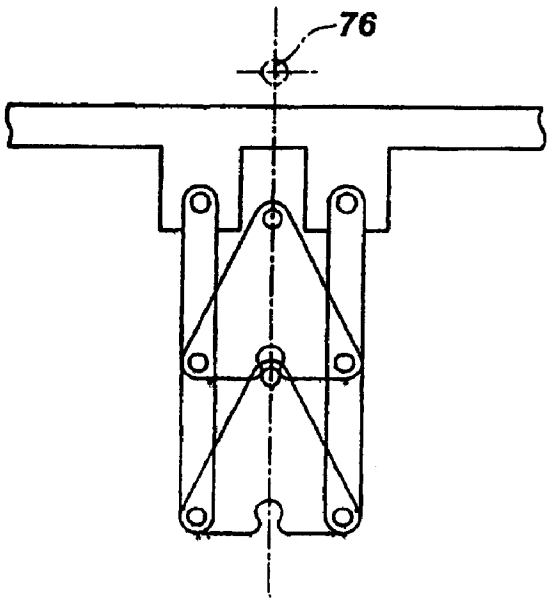
PRIOR ART FIG. 29
FIG. 29 is a diagrammatic view corresponding to FIG. 30 with the cartridge shown in a neutral untitled position.
Figure 30:
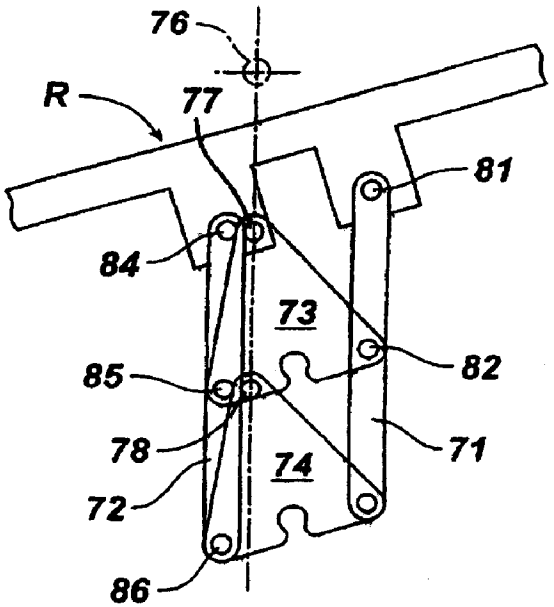
PRIOR ART FIG. 30
FIG. 30 is a view corresponding to FIGS. 28 and 29 with the cartridge pivoted to the other side.

The linkage arrangement known from U.S. Pat. No. 6,115,924, which is hereby incorporated by reference, will be described in more detail with reference to FIGS. 28, 29 and 30. Each of FIGS. 28, 29 and 30 shows a rockable cartridge R mounted on a shaver handle in a manner to permit the cartridge to be rocked from a central position, shown in FIG. 31, to either the right hand side, shown in FIG. 28, or the left hand side, shown in FIG. 30. The head R will carry one or more razor blade units. The rocking movement of the cartridge head is achieved by means of a parallelogram linkage. The shaver head R is mounted on the upper ends of two pairs of vertical side members 71 and 72, one pair of side members being provided at each end of the shaver, and only one side being shown in FIGS. 28, 29 25 and 30. At each end of the shaver, the pair of vertical side members 71 and 72 constitutes, in combination with transverse link members 73 and 74, a four bar mounting linkage. Each of links 73 and 74 constitutes a bell crank lever.

The bell crank levers 73 and 74 are pivoted at respective pivot points 77 and 78 to fixed points of the handle. These fixed points of the shaver frame are located on a central plane 75 of the linkage mechanism, this plane forming a plane of symmetry when the mechanism is in the neutral position shown in FIG. 29. Through this construction, a virtual pivot axis 76 is produced well above the points of attachment of the vertical side members 71 and 72 to the shaver head R. In fact, the virtual pivot axis 76 may be located on, above or below skin level in dependence upon the size of the pivoting triangles or bell crank links 73 and 74, and indeed, approximately spaced as far above the attachment points as the height of a triangular shaped bell crank 73 between its connection points 82, 85 and its pivot location 77. This may be achieved without the need for a physical upper pivot location.

Each of the vertical side members 71 and 72 is attached to the remainder of the mechanism at three pivot axes. For example, side member 71 is attached to the rocking cartridge R at axis 81, to the transverse link member 73 at axis 82, and to the transverse link member 74 at axis 83. Similarly, the second vertical side member 72 is attached at axes 84, 85 and 86 respectively.

Applicant herein has recognized that in order to function correctly, the pivot axes 81, 82 and 83 have to lie in a common plane parallel to a similar plane containing the pivot axes 84, 85 and 86. Each plane is moreover parallel to the central plane of symmetry 75. If, as seen in this side cross-sectional view, a line connecting pivots 81, 82, 83 were not parallel to a similar line connecting pivots 84, 85, 86, the mechanism would jam. As a consequence, the width of the linkage mechanism is essentially determined by the spacing between the axes of attachment 81 and 84 to the rocking cartridge R. Applicant herein has recognized that this is a disadvantage if it is desired to make the linkage mechanism more compact, for example to produce a slim handle or handle housing.

In the cross-sectional view of linkage arrangement shown in FIGS. 28, 29 and 30, the axes of attachment 77, 82 and 85 of the upper transverse link 73 form a triangle which is congruent to the triangle formed by the axes of attachment 78, 83 and 86 of the lower transverse link member 74.

Several embodiments of the present invention will be described in the following.

In the present invention, the constraint, for example, that the linkage be nearly as wide as its attachment location to the cartridge, is no longer necessary. The present invention employs an upper transverse linkage arrangement which is not congruent with the lower transverse linkage portion but which nevertheless generates a virtual pivot axis to permit rocking movement of the cartridge. The embodiments of the invention employ a five bar linkage comprising a main transverse link, two lateral support arms and two transverse stabilizing links. This permits a wide range of possible positions of the virtual pivot axis and also gives the designer the ergonomic freedom to package a large cartridge together with a relatively thin and skinny handle.

In the conventional parallelogram linkage, the centres of rotation of the transverse links lie in a plane which is usually coincident with the vertical plane of symmetry of the handle. In contrast, in some of the illustrated embodiments of the present invention, the transverse stabilizing links have inboard pivot locations which are spaced laterally away from one another. In further preferred embodiments, at least one of these pivot locations, or preferably both, are spaced from the imaginary vertical plane of symmetry of the linkage mechanism.

Figure 1:
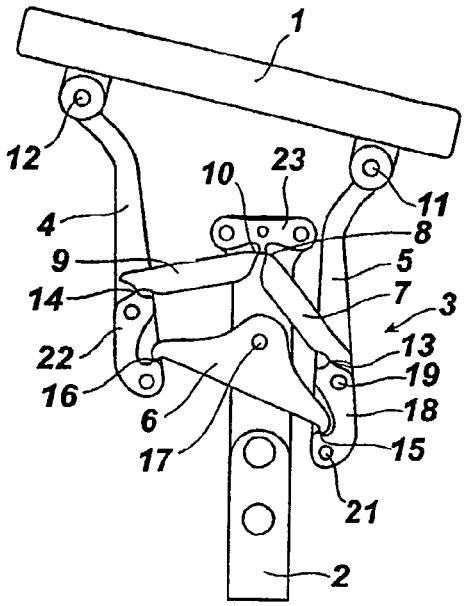
FIG. 1 is a SIDE view of a shaver cartridge mounted for rocking movement on a shaver handle according to a first embodiment of the invention, with the cartridge pivoted to one side.
Figure 2:
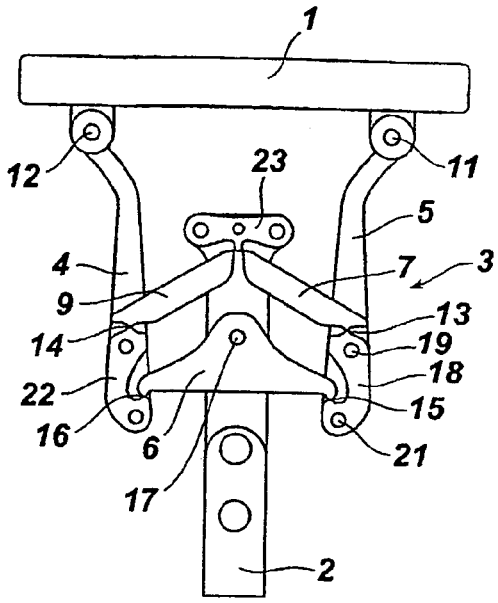
FIG. 2 is a side view corresponding to FIG. 1, with the cartridge in a neutral mid position.

Referring to the drawings in more detail, FIGS. 1 and 2 show a rocking cartridge 1 mounted on a handle 2, schematically shown, by means of a linkage mechanism 3. The linkage mechanism 3 comprises a pair of vertically extending support arms 4 and 5 pivotably mounted to the head 1 at upper pivot axes 12 and 11 respectively. The head 1 typically carries, in this embodiment, three blades 31, 32 and 33. The blades are better shown in FIGS. 3 and 4, and are preferably of the type disclosed in U.S. Pat. No. 6,115,924 (Oldroyd), which is hereby incorporated by reference.

At the lower end of the support arm 5 is provided a support member 18 which is riveted to the support arm 5 by means of rivets 19, 20 and 21. A similar support member 22 is riveted to the lower end of the support arm 4.

A main transverse link member 6 is pivotably mounted on a housing frame 2 at a pivot axis 17 and has two limbs or mounting ends pivotably connected to the support members 18 and 22 (also referred to as connecting links) by respective film hinges allowing pivoting about axes 15 and 16. The main transverse link may be referred to as a common link since it interconnects both support members.

Two stabilizing transverse link members 7 and 9 are also provided. An upper support member 23 is riveted to the shaver body 2. The transverse link members 7 and 9 are each pivotably connected to the upper support 23 by respective film hinges allowing pivoting about axes 8 and 10. Thus, the locations at which the stabilizing link members, preferably at the upper part of the mechanism, are connected to the housing frame are spaced apart. The link members 7 and 9 are also pivotably connected to the first and second lower support members 18 and 22 by further film hinges 13 and 14 respectively.

It will be appreciated that the distance between the upper pivot axes 11 and 12 is greater than the distance between the axes of pivot hinges 13 and 14, which in turn is greater than the distance between the axes of pivot hinges 15 and 16. In the illustrated embodiment, the two upper transverse link members 7 and 9 are pivoted to the frame member 2 on two different pivot axes 8 and 10. The pivot points 8, 10 and 17 thus form the vertices of an isosceles triangle. It will be appreciated that in other embodiments, see e.g. FIGS. 5–7, such a triangle formed by these pivot axes is not necessarily an isosceles triangle. Since the upper link members 7 and 9 are not rigidly connected together, it will be appreciated that the distance between the film hinges 13 and 14 is not constant during rocking of the head 1. Nevertheless, it remains smaller than the distance between the pivot points 11 and 12 throughout the range of movement of the head 1. Similarly, the distance between the film hinges 13 and 14 remains greater than the distance between the film hinges 15 and 16 throughout the range of movement.

It will also be appreciated that in this embodiment the pivot axes associated with the right-hand support arm 5, i.e. axes 11, 13 and 15, lie in a first common plane (that is, as viewed in transverse cross-section as in FIGS. 1–2, they appear co-linear). Similarly, the pivot axes 12, 14 and 16 associated with the left-hand support arm 4 lie in a second common plane. The first and second common planes are inclined at an acute angle which varies slightly during the rocking action of the head 1. However, it is not essential that these three pivot axes 11, 13, 15 or 12, 14, 16 be coplanar (appear colinear), see e.g. FIGS. 5–7 or FIGS. 8–10.

FIG. 1 shows the mechanism pivoted to one side. FIG. 2 shows the mechanism in its central position, where the head 1 is located at its central position. In this position, the distance between the film hinges 13 and 14 is at its maximum.

Figure 3:
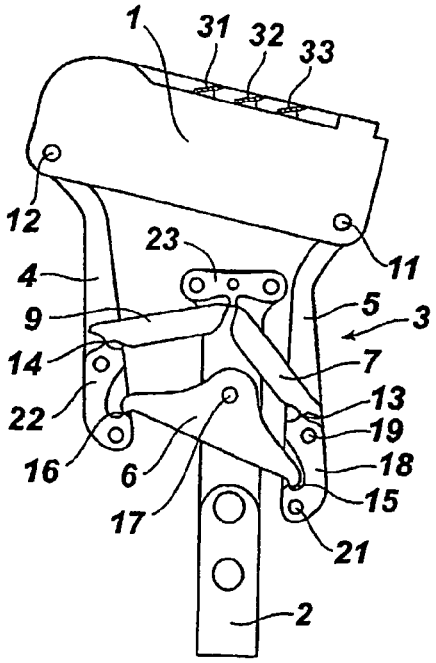
FIG. 3 is a side view of the shaver cartridge mounted for rocking movement on a shaver handle according to a second embodiment of the invention, with the cartridge pivoted to one side.
Figure 4:
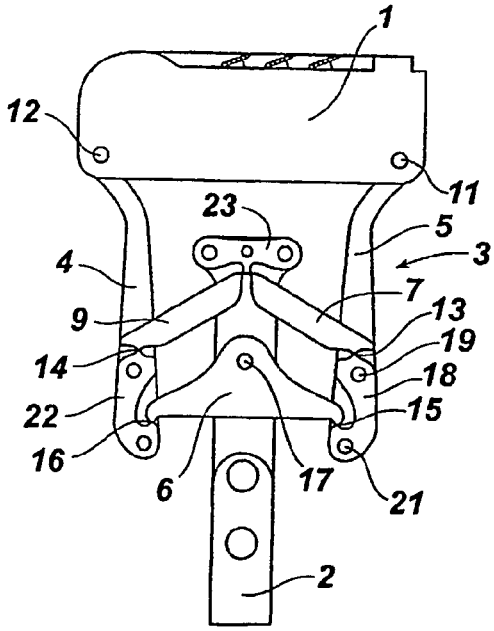
FIG. 4 is a side view corresponding to FIG. 3, with the cartridge in a neutral position.

FIGS. 3 and 4 show an alternate embodiment of the present invention. Whereas the embodiment of FIGS. 1 and 2 uses the mechanism to permit pivoting of the cartridge from side-to-side, the embodiment of FIGS. 3 and 4 uses the mechanism to permit pivoting of the cartridge from front-to-back.

Figure 5:
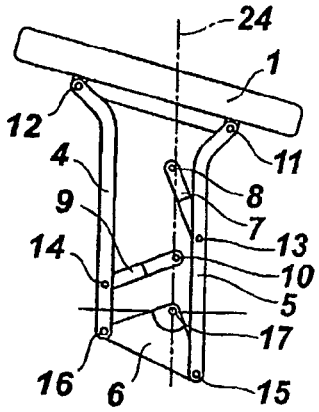
FIGS. 5 to 7 show a schematic side view of a further linkage mechanism according to the invention.
Figure 6:
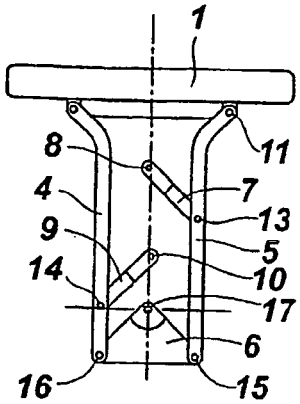
Figure 7:
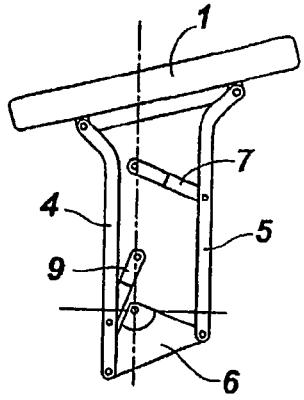
Figure 8:
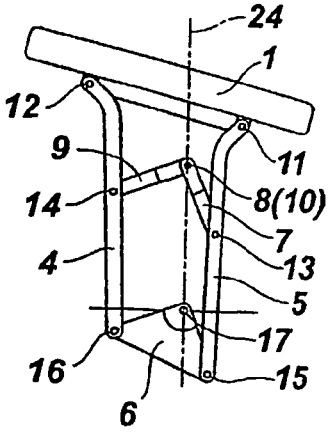
FIGS. 8 to 10 show a schematic side view of a further linkage mechanism according to the invention.
Figure 9:
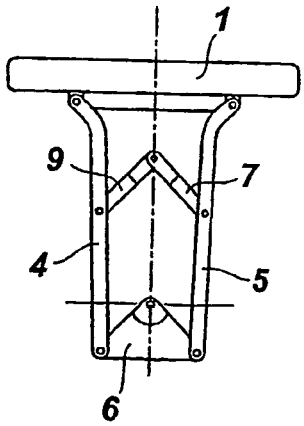
Figure 10:
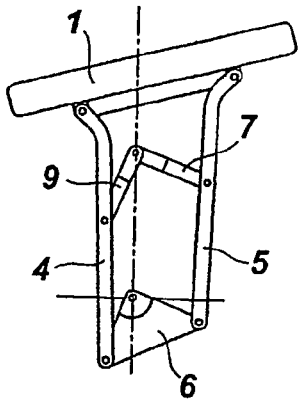

In the embodiment of FIGS. 1 to 4, the head 1 can pivot by an angle of ±9.5°. Modification of the design by enlargement of the lower transverse link member 6 and corresponding adjustment of the lengths of the upper transverse link members 7 and 9, can result in an increased pivot angle. Further modifications will occur to those skilled in the art on the basis of the above disclosure. For example, the use of film hinges is not essential. These could equally be replaced by pin hinges, as shown in FIGS. 5 to 19. Moreover, although it is thought essential to provide two transverse stabilizing link members 7 and 9 which are articulated relative one another (that is, they move relative to one another) to avoid the mechanism locking up, it is not essential that these should be pivoted at spaced pivot points. It would be equally possible for the transverse stabilizing link members 7 and 9 to be pivoted on the handle 2 at a common axis as shown in FIGS. 8 to 10. It would even be possible for the transverse link members 7 and 9 to cross over each other or over the central plane, such as shown in FIGS. 5 to 7. For example, with reference to FIG. 5, the left hand side of link 7 is attached to the frame at a location further to the left than the location at which link 9 is attached to the frame.

FIGS. 5 to 7 also demonstrate that the points of attachment of the stabilizing links 7 and 9 to the support arms 4 and 5 may be at differing distances from the head 1.

Figure 11:
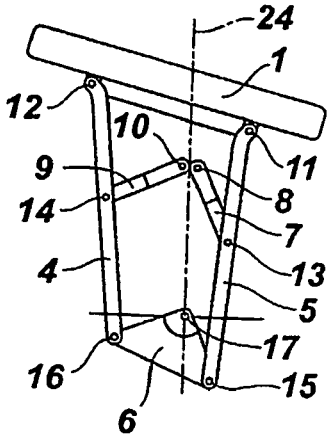
FIGS. 11 to 13 show a schematic side view of a further linkage mechanism according to the invention.
Figure 12:
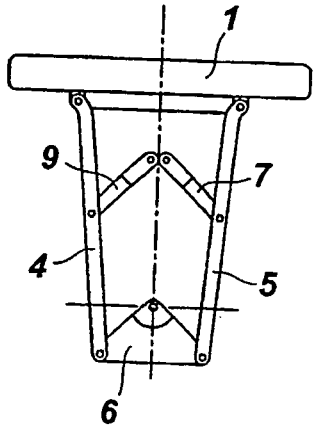
Figure 13:
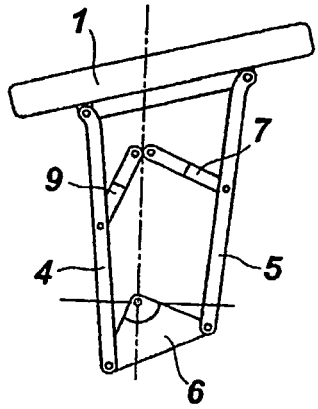

FIGS. 11 to 13 show a simplified embodiment essentially equivalent to that of FIGS. 1 to 3, but with pin hinges replacing the film hinges.

Figure 14:
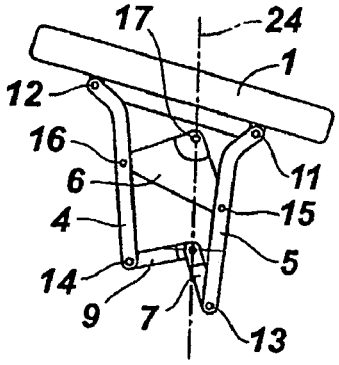
FIGS. 14 to 16 show a schematic side view of a further linkage mechanism according to the invention.
Figure 15:
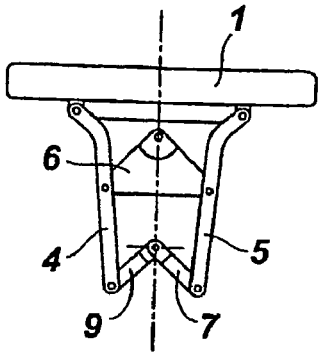
Figure 16:
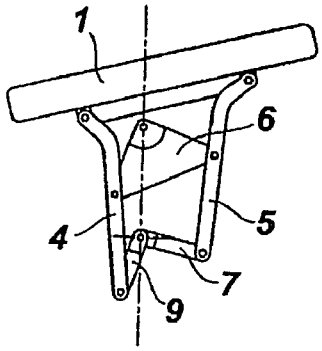

FIGS. 14 to 16 demonstrate that the main transverse link member 6 may be located between the head 1 and the transverse stabilizers 7 and 9.

Figure 17:
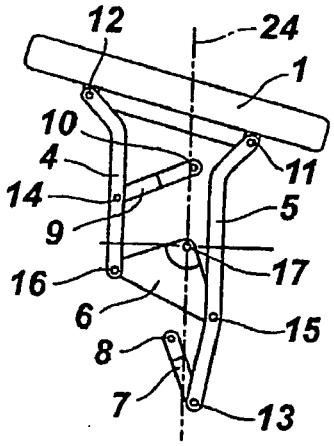
FIGS. 17 to 19 show a schematic side view of a further linkage mechanism according to the invention.
Figure 18:
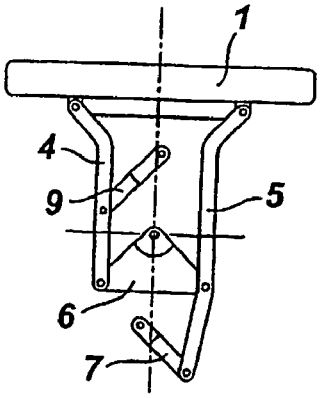
Figure 19:
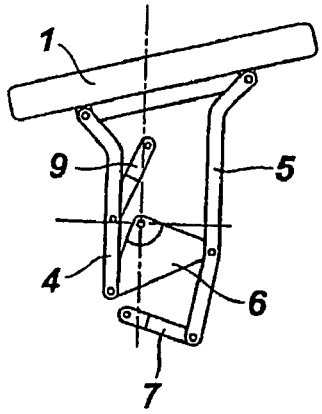

FIGS. 17 to 19 demonstrate that it is even possible for the two stabilizers 7 and 9 to be positioned respectively above and below the main transverse link member 6.

Figure 20:
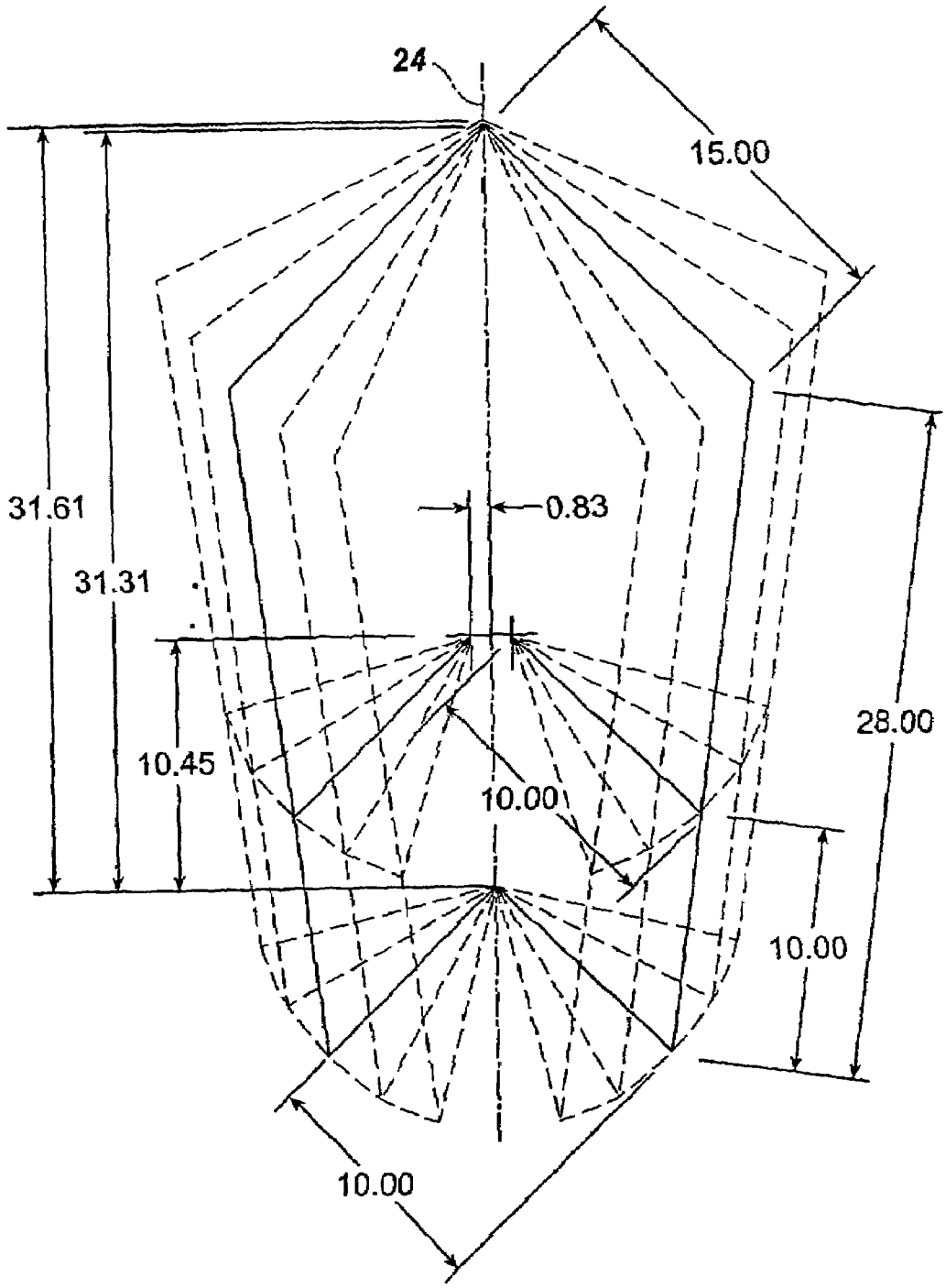
FIGS. 20 to 26 show schematic views of linkage mechanisms according to embodiments of the invention, in which dimensions are indicated.
Figure 21:
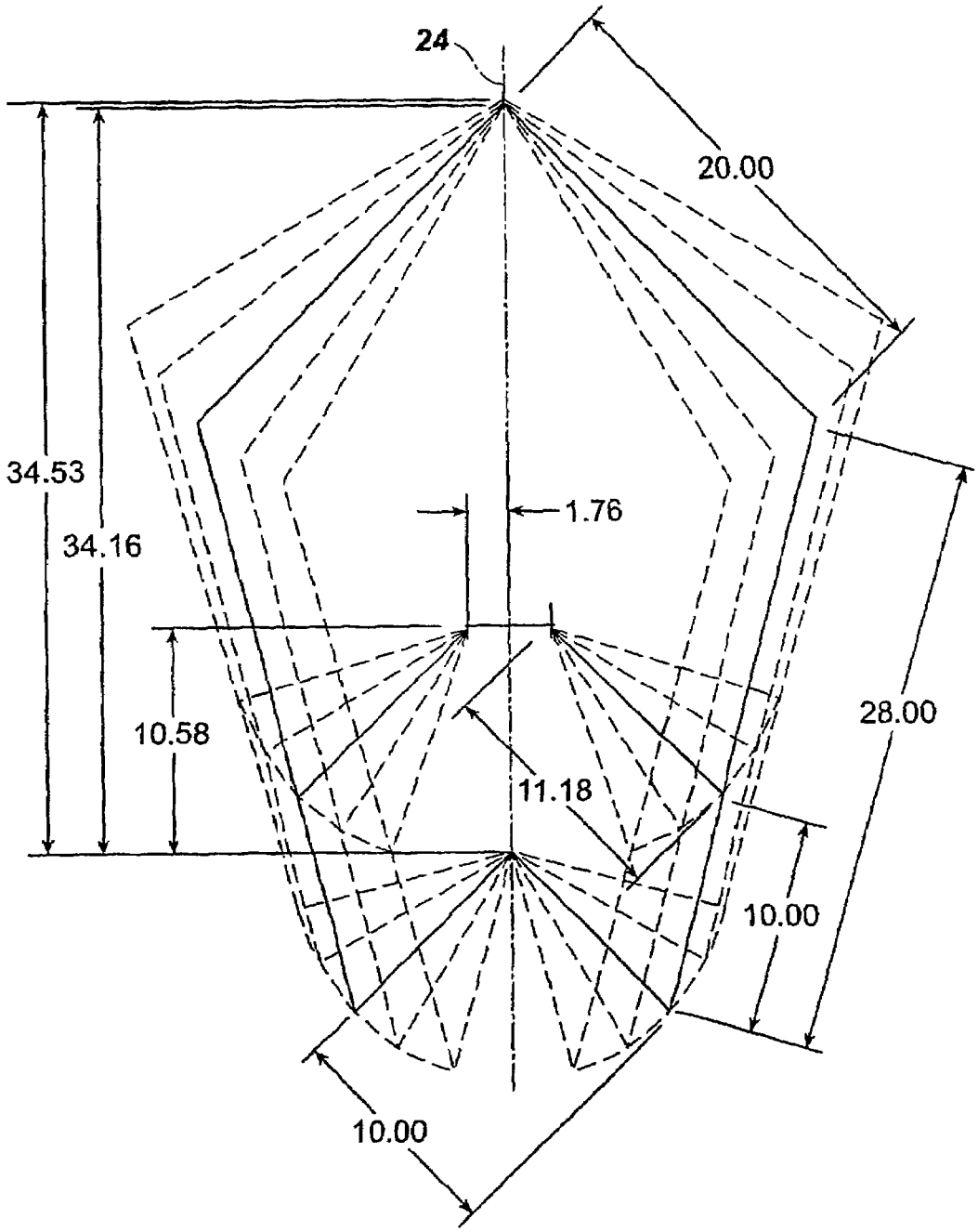
Figure 22:
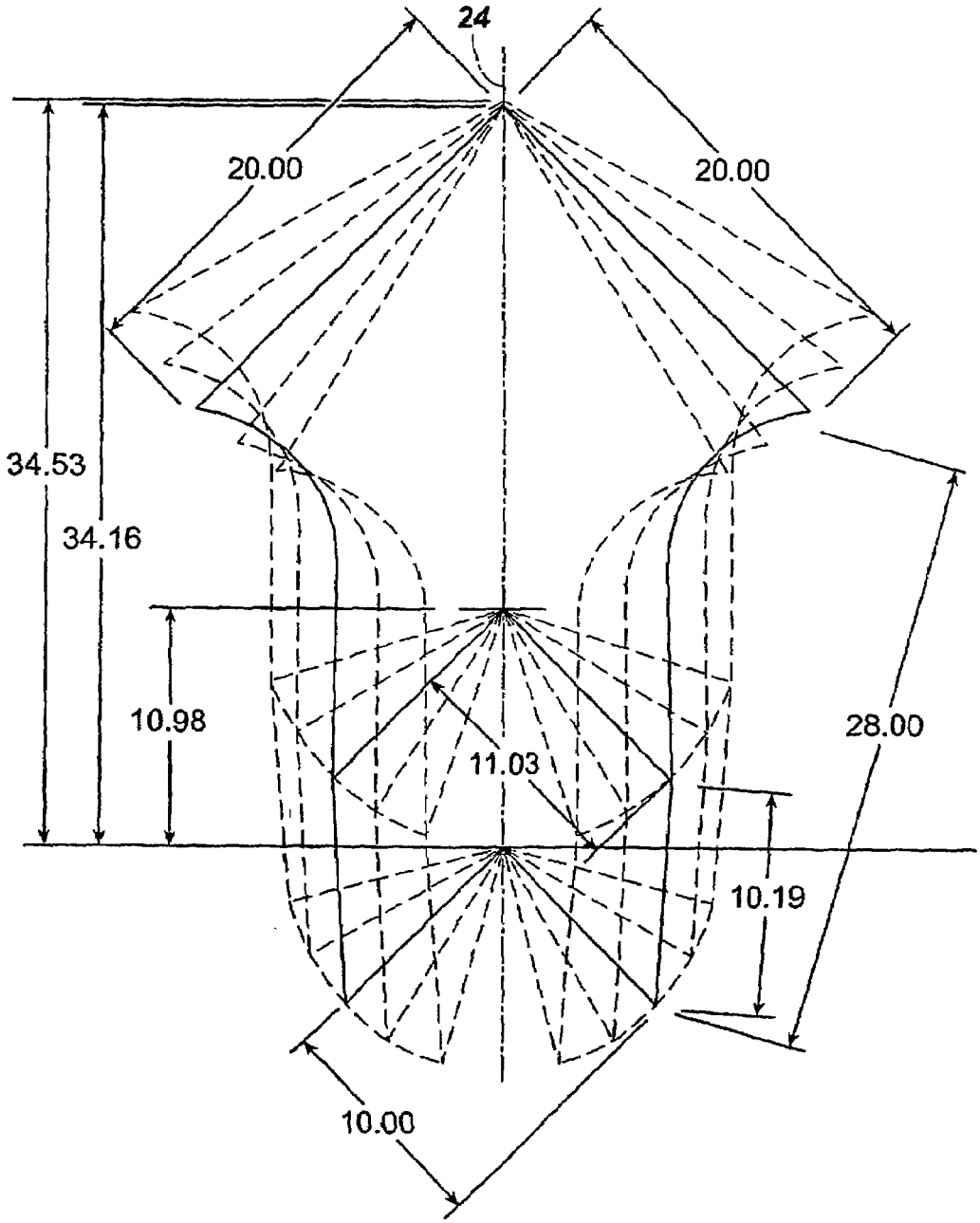
Figure 23:
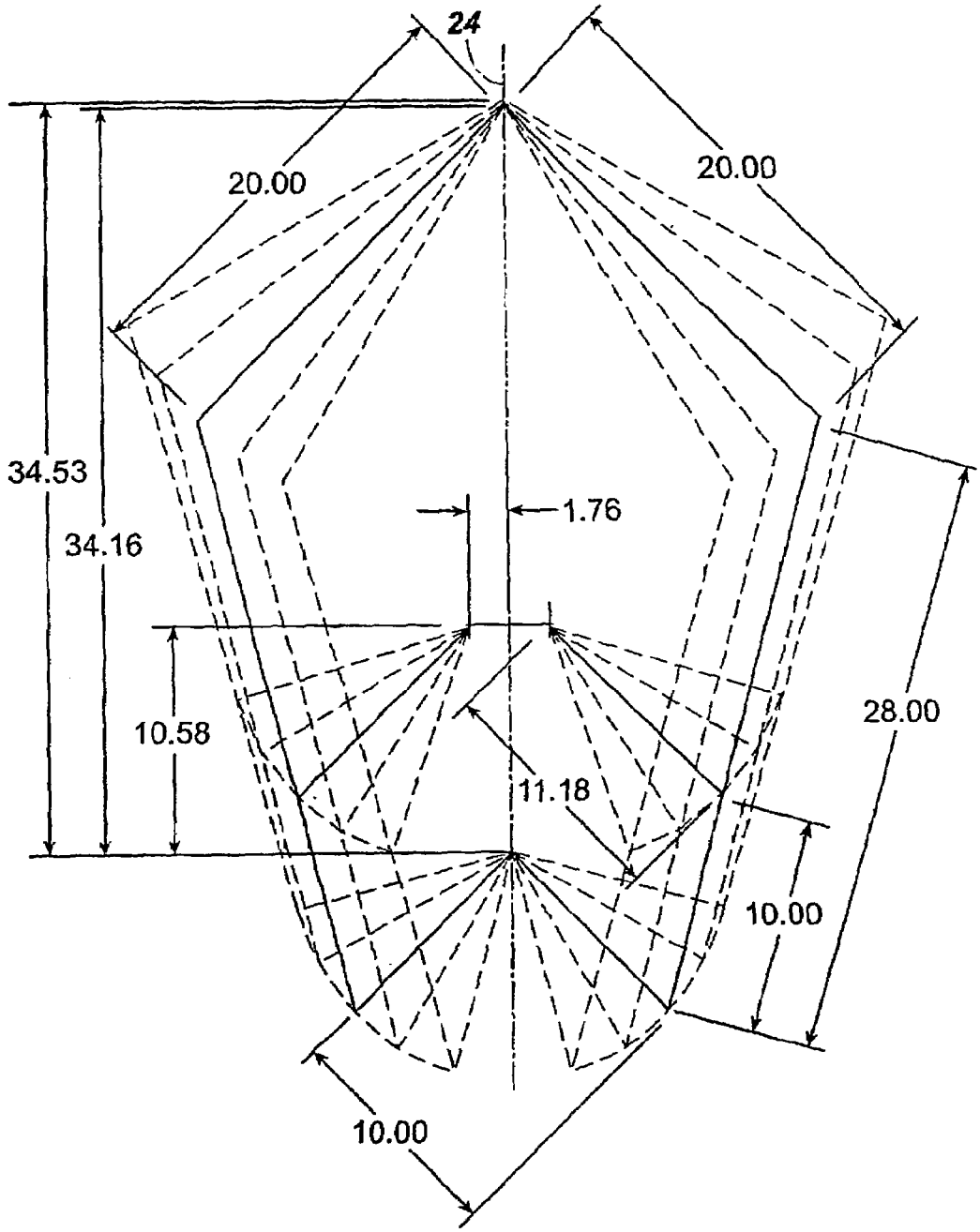
Figure 24:
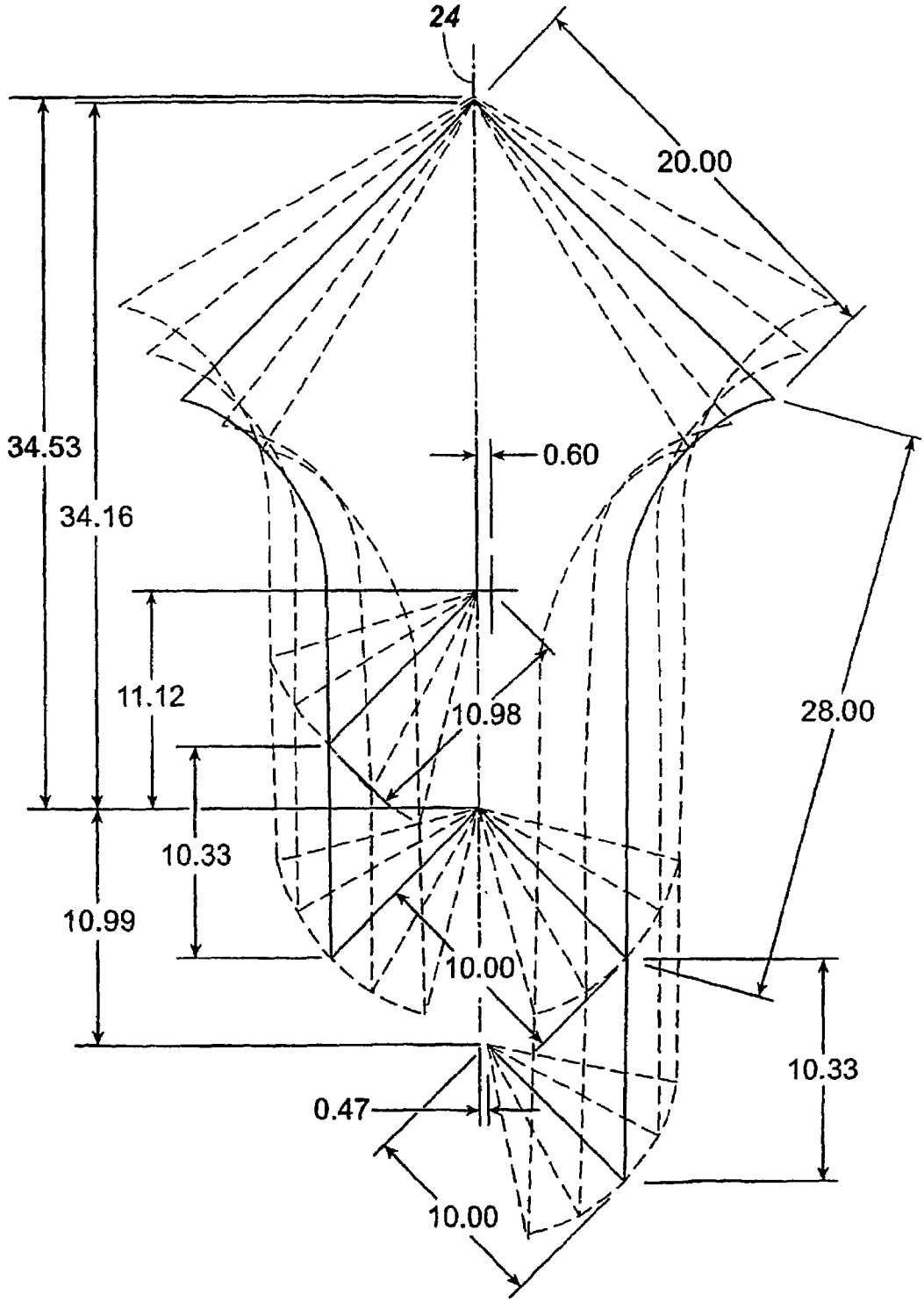
Figure 25:
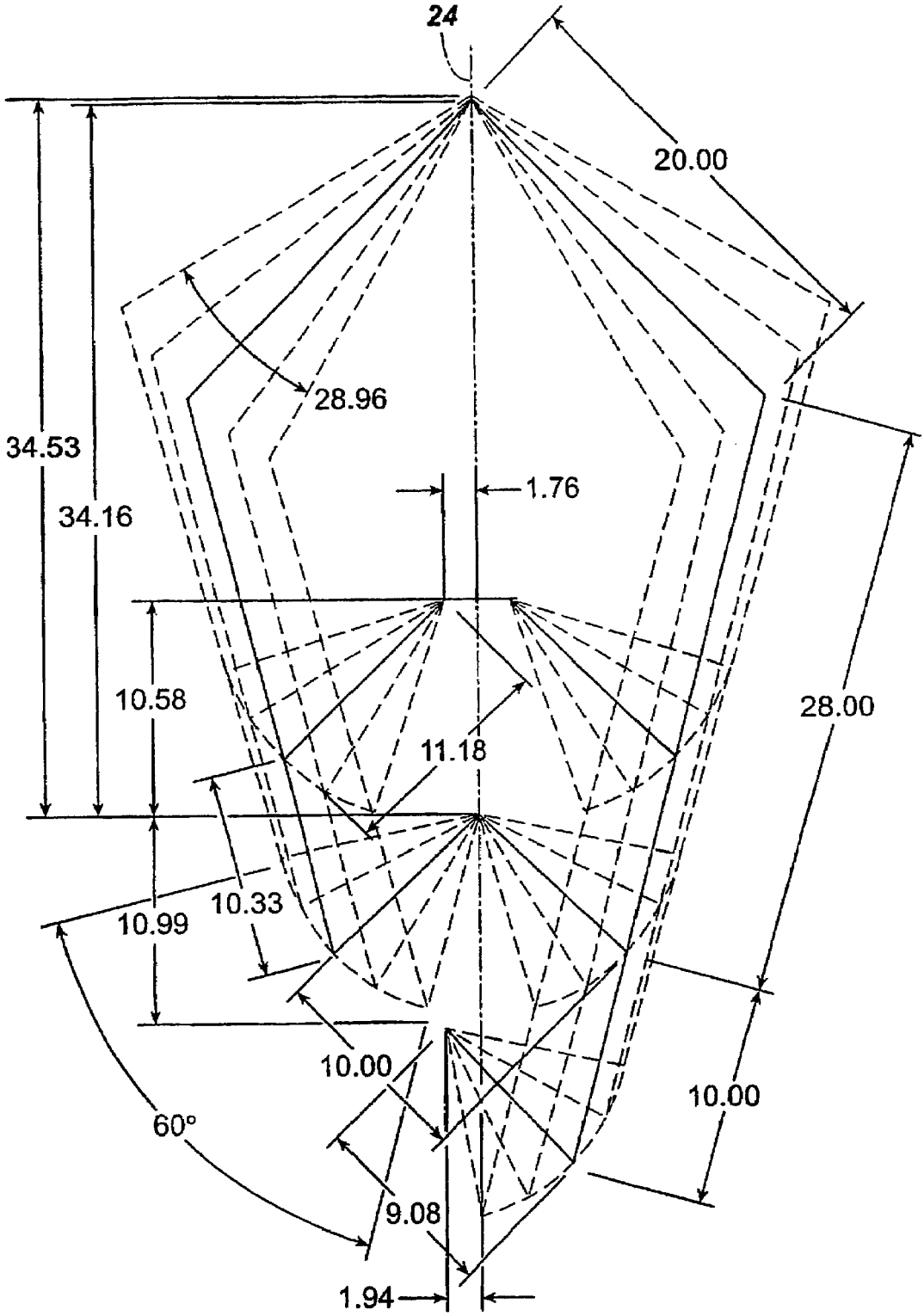

FIG. 20 shows a schematic representation of a linkage mechanism according to an embodiment of the invention exemplified by that in FIGS. 1 to 4 or FIGS. 11 to 13, in which the dimensions of the various components of the mechanism are indicated. The Figure also shows in phantom line a series of positions adopted by the mechanism as it rocks from one extreme position to the other. During this motion of about ±19.5 degrees (38.94° included angle) of travel of the virtual upper triangle (sides of 15 mm) about the virtual pivot axis 24, the virtual pivot axis, whilst remaining on the central plane of symmetry, moves vertically by a distance of 0.3 mm. In the embodiment shown in FIG. 21, where the dimensions of the individual components are slightly different, the virtual pivot axis moves vertically by a distance of 0.37 mm over an amount of travel of about ±14.5 degrees (28.96° included angle) of the upper virtual triangle (sides of 20 mm). In the embodiment of FIG. 20, the top arm, meaning the distance from the virtual pivot to the point of attachment of each support arm, has a length of 15 mm. In FIG. 21, the top arm has a length of 20 mm. The bottom triangle determined by the main transverse link (10 mm) is the same in each of FIGS. 20 and 21, and is rotated through the same ±30 degree of travel (60° included angle). The upper virtual triangle in FIG. 21 is referred to as "twice the size" of the lower triangle (20:10), whereas the upper virtual triangle in FIG. 20 is referred to as "one-and-one-half the size" of the lower triangle (15:10).

The following table gives the height of the virtual pivot from the point of attachment of the main transverse link to the frame for a succession of angles of rotation of the main transverse link member. The table gives these values for the embodiments of FIGS. 20 and 21.

| Angle of rotation of bottom triangle | Height of Apex of top triangle from apex of bottom triangle (mm) | |
|---|---|---|
| | Top arm = 15 mm | Top arm = 20 mm |
| 0 | 31.3114 | 34.1635 |
| 5 | 31.3193 | 34.1735 |
| 10 | 31.3430 | 34.2034 |
| 15 | 31.3827 | 34.2534 |
| 20 | 31.4393 | 34.3237 |
| 25 | 31.5136 | 34.4148 |
| 30 | 31.6067 | 34.5268 |

It will thus be appreciated that the slight amount of deviation during rotation of the virtual pivot axis from its at-rest neutral position is used as a design trade-off considering the size of the envelope within which the linkage can be contained and the desired amount of arc travel. It is noted that when using a conventional fixed pin bearing (physical axis) or a shell-like bearing (virtual axis) to support a shaving head about a pivot axis close to the shaving plane, such a pivot axis remains theoretically unchanged through the arc of travel. The present invention's linkage generates a dynamic virtual pivot axis that moves outward towards the skin surface only a small, finite amount and is acceptably close to a static pivot axis.

At least for upper virtual triangles whose sides have lengths that are longer than the lengths of the sides of the lower triangle, then, as between two differently sized upper virtual triangles (cf. FIGS. 20 and 21), the smaller the upper virtual triangle is (e.g. FIG. 20), then the greater is the amount of arc travel that it can undergo for a given amount of arc travel of the lower common link, thus reducing overall width of the linkage in the handle, thus resulting in a spatial economy of handle size.

Figure 26:
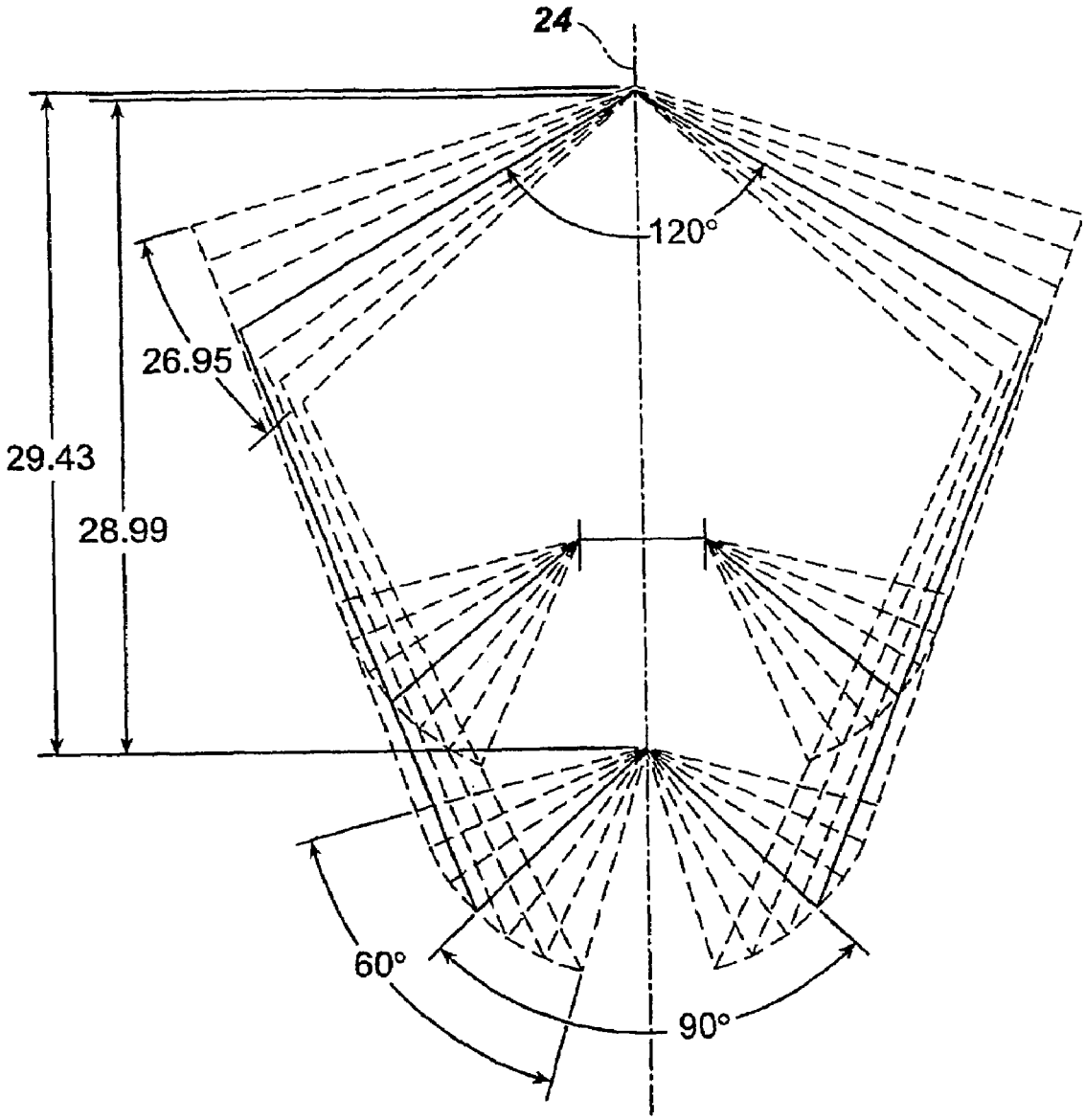

FIGS. 22 to 26 show schematic representations of further variants of the linkage mechanism according to the invention. It may be seen that in each case the head supported by the support arms is able to rotate by a total angle of approximately 25° whilst the virtual pivot is substantially static and moves only very slightly in a vertical direction. Whilst in most of the illustrated embodiments the angle included between the two top arms is equal to the angle subtended by the two limbs of the main transverse link member, FIG. 26 shows that this is not necessarily the case. Here, the angle subtended by the two top arms is 120° whilst the angle subtended by the two limbs of the main transverse link member is 90°.

Figure 27:
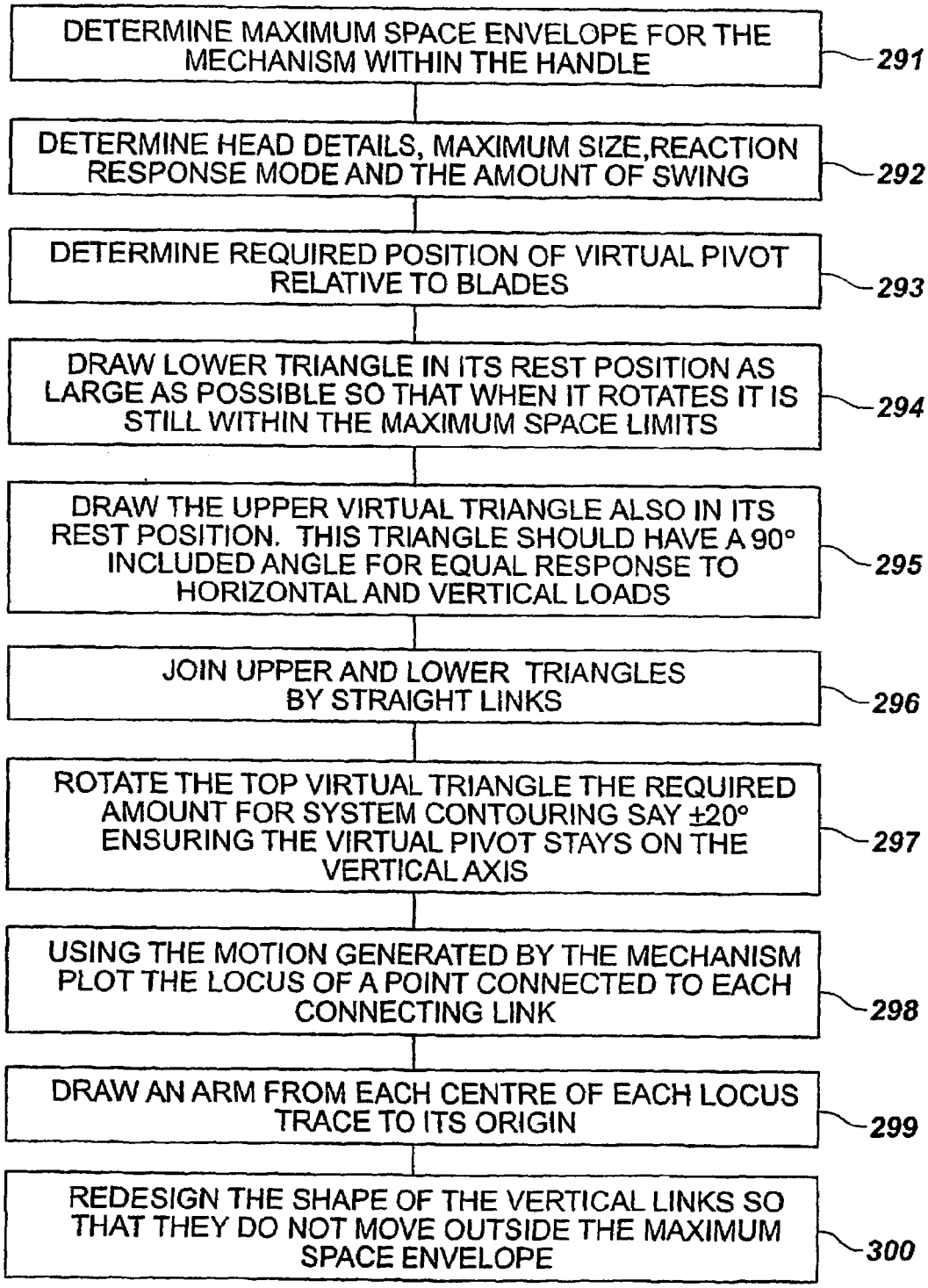
FIG. 27 shows a flow chart of a design method.

Next, the design process by which a linkage mechanism for use in a hair removal device can be generated will be described with reference to FIG. 27. Here it is assumed that the depilation appliance, e.g. a shaving head, will be mounted on a handle which provides only limited space to contain the mechanism. Accordingly, the first step 291 in the design process is to determine the maximum space envelope for the mechanism within the handle. Next the details of the head must be determined including its maximum size, desired reaction response mode and the desired amount of swing (step 292). The required position of the virtual pivot relative to the blades will then be determined (step 293). With this basic information, the main transverse link, referred to in FIG. 27 as a lower triangle, will be drawn in its rest position at a size as large as possible. (step 294) whilst nevertheless ensuring that it remains within the maximum space limits when rotated (The lower link could even be a straight bar rather than a triangle, but the flatter the link then, it is believed, the less it will react to horizontal forces but the more it would react to downward forces). Next the upper virtual triangle is drawn in its rest position having the virtual pivot as its apex (step 295). This triangle will preferably have a 90° included angle to ensure equal response to horizontal loads (associated with drag on the skin) and vertical loads (associated with pushing into the skin). The upper and lower triangles are then joined by straight links which represent initial placement of the support members (step 296). The top virtual triangle is then rotated by the required amount, e.g. ±20°, ensuring that the virtual pivot remains on the vertical axis (step 297). Using the motion generated by the mechanism, the locus of a point on each connecting link is then plotted (step 298). An arm is then drawn from a centre of each locus to its origin in order to generate the stabilizing transverse link (step 299). The designer has the freedom to choose a location along the extent of the vertical link where it will be spatially convenient to place the stabilizing link, and this location does not have to be the same on both vertical links. Now that the basic mechanism has been determined, the shape of the vertical links can be redesigned (step 300) as the finished support member to ensure that they do not move outside the maximum space envelope. It will be appreciated in steps 294 and 295 that as between two different arrangements generating two differently sized "upper virtual triangles", one larger and the other smaller then the smaller one will yield less "displacement error", or in other words the smaller the displacement of the virtual pivot axis during arc travel becomes. It is also not required that the lower triangle and the "upper virtual triangle" be similar triangles (reference is again made to FIGS. 20 and 21). In contrast, it is noted that in prior art four-bar links, the several transverse links or bell cranks arranged in ladder-like arrangement were constrained to be congruent to one another.

The linkage of the present invention is preferably oriented as shown in FIGS. 1 and 2, but it is also possible to orient it ninety degrees thereto to generate a end-to-end pivoting of the head, as shown in FIGS. 3 and 4.

Further modifications will occur to those skilled in the art. All such modifications are intended to be covered by the following claims, irrespective of their summary in the claims or their back references.

Without limiting the scope of the invention, reference numbers used herein are listed:

Table of Reference Numerals

| | |
|---|---|
| 1. | Rocking cartridge |
| 2. | Handle |
| 3. | Linkage mechanism |
| 4. | Support arm |
| 5. | Support arm |
| 6. | Main transverse link |
| 7. | Stabilizing transverse link |
| 8. | Pivot axis |
| 9. | Stabilizing transverse link |
| 10. | Pivot axis |
| 11. | Upper pivot axis |
| 12. | Upper pivot axis |
| 13. | Pivot hinge |
| 14. | Pivot hinge |
| 15. | Pivot hinge |
| 16. | Pivot hinge |
| 17. | Mounting pivot |
| 18. | Support member |
| 19. | Rivet |
| 20. | Rivet |
| 21. | Rivet |
| 22. | Support member |
| 23. | Support member |
| 31. | Blade |
| 32. | Blade |
| 33. | Blade |
| 71. | Side plate |
| 72. | Side plate |
| 73. | Transverse link member |
| 74. | Transverse link member |
| 75. | Central plane |
| 81. | Pivot axis |
| 82. | Pivot axis |
| 83. | Pivot axis |
| 84. | Pivot axis |
| 85. | Pivot axis |
| 86. | Pivot axis |

The invention claimed is:

1. A linkage mechanism for a razor having a cartridge (1) carrying at least one razor blade and mounted for rocking about a virtual axis, said linkage mechanism being mountable on a handle (2) and comprising a pair of spaced support arms (4,5) for pivotable attachment to the cartridge (1) at first and second pivot axes (11, 12), said first and second pivot axes being spaced apart by a first distance;

a first transverse link member (6) pivotable mounted on said handle (2) for rotation about a third axis (17) and being pivotably attached to each of said support arms (4, 5), at fourth and fifth pivot axes (15, 16) spaced apart by a second distance less than the first distance and second and third transverse link members (7, 9) pivotably mounted on the handle (2) at respective first ends thereof and being pivotably attached at respective second ends thereof to respective ones of said support arms (4, 5) at sixth and seventh pivot axes (13, 14) spaced apart by a third distance, said first, second, third, fourth, fifth, sixth and seventh axes being mutually parallel.

2. A mechanism according to claim 1, wherein said third distance is less than said first distance.

3. A mechanism according to claim 2, wherein said third distance is less than said second distance.

4. A mechanism according to claim 2, wherein said third distance is less than said third distance.

5. A mechanism according to claim 1, wherein said respective first ends of the second and third transverse link members (7, 9) are pivotally mounted on the handle at eighth and ninth pivot axes (8, 10) which are spaced apart, and parallel to said first and second axes.

6. A mechanism according to claim 5, wherein a plane perpendicular to said eighth and ninth pivot axes intersects said third, eighth and ninth axes (17, 8, 10) at spaced points forming an isosceles triangle.

7. A mechanism according to claim 5, wherein said eighth and ninth axes (8, 10) are colinear.

8. A mechanism according to claim 5, wherein said third, eight and ninth axes (17, 8, 10) and said virtual axis are parallel.

9. A mechanism according to claim 1, wherein the distance between said first and sixth axes (11, 13) equals the distance between said second and seventh axes (12, 14).

10. A mechanism according to claim 1, wherein the distance between said first and sixth axes (11, 13) is greater than the distance between said second and seventh axes (12, 14).

11. A mechanism according to claim 1, wherein the distance between said first and fourth axes (11, 15) equals the distance between said second and fifth axes (12, 16).

12. A mechanism according to claim 11, wherein the distance between said first and sixth axes (11, 13) equals the distance between said second and seventh axes (12, 14) and wherein the distance between said first and sixth axes (11, 13) is less then the distance between said first and fourth axes (11, 15).

13. A mechanism according to claim 11, wherein the distance between said first and sixth axes (11, 13) equals the distance between said second and seventh axes (12, 14) and wherein the distance between said first and sixth axes (11, 13) is greater than the distance between said first and fourth axes (11, 15).

14. A mechanism according to claim 11, wherein the distance between said first and sixth axes (11, 13) is greater than the distance between said second and seventh axes (12,14) and wherein the distance between said first and sixth axes (11, 13) is greater than the distance between said first and fourth axes (11, 15) and the distance between said second and seventh axes (12, 14) is less than the distance between said second and fifth axes (12, 16).

15. A mechanism according to claim 1, wherein the first, second and third transverse link members (6, 7, 9) are pivotably attached to said support arms by respective film hinges.

16. A mechanism according to claim 1, wherein the second and third transverse link members are attached to the handle by respective film hinges (8, 10).

17. A mechanism according to claim 1, wherein the second and third transverse links are moveable relative to one another.

18. A mechanism according to claim 1, wherein the support arms (4, 5) are not parallel to one another.

19. A mechanism according to claim 1, wherein the first link member (6) is configured as a bell crank.

20. A razor comprising:

the linkage mechanism according to claim 1;

and the cartridge (1) carrying the at least one razor blade supported on said linkage mechanism mounted on said handle (2) for rocking about said virtual axis.

21. A linkage mechanism for a razor having a head (1) carrying at least one razor blade and mounted for rocking about a virtual axis generated by said linkage mechanism, said linkage mechanism being mountable on a handle (2) and comprising:

a pair of spaced support arms (4, 5) pivotally connectable to the head (1) at first and second pivot axes (11, 12);

a first common link member (6) pivotably mounted to said handle (2) for rotation about a third axis (17) and being pivotably attached to each, of said support arms (4, 5), at fourth and fifth pivot axes (15, 16); and second and third transverse link members (7, 9) pivotably mounted on the handle (2) at respective first ends thereof and being pivotably attached at respective second ends thereof to respective ones of said support arms (4, 5) at sixth and seventh pivot axes (13, 14).

22. A mechanism according to claim 21, wherein the first, the fourth and the sixth axes (11, 15, 13) define a first set of three axes and the second, the fifth and the seventh axes (12, 5, 14) define a second set of three axes, and wherein the three pivot axes within at least one set of said first and second sets of axes are co-planar.

23. A razor comprising:

a handle;

a linkage mechanism mounted on the handle; and a cartridge (1) mounted for rocking about a virtual axis generated by said linkage mechanism, said linkage mechanism comprising:

a head (1) carrying at lest one razor blade;

first and second spaced support arms (4, 5) pivotally connected to the head (1) at first and second pivot axes (11, 12);

a first common link member (6) pivotably mounted to said handle (2) for rotation about a third axis (17) and being pivotably attached to each of said support arms (4, 5), at fourth and fifth pivot axes (15, 16); and at least one stabilizing link member (7) pivotably mounted on the handle (2) and being pivotably attached to only one of said first and second said support arms (4, 5).

24. A razor according to claim 23, further comprising a second stabilizing link member (9) pivotably mounted on the handle (2) at a first end thereof and being pivotably attached at a second end thereof to the other of said first and second said support arms (4, 5) at another pivot axis (14).

25. A method of mounting a component (1) carrying at least one razor blade mounted for rocking about a virtual axis the method comprising the steps of:

pivotably attaching a pair of spaced support arms (4, 5) to the component (1) at first and second pivot axes (11, 12), said first and second pivot axes being spaced apart by a first distance;

pivotably mounting a first transverse link member (6) on a handle (2) for rotation about a third axis (17) and pivotably attaching the first link member (6) to each of said support arms (4, 5), at fourth and fifth pivot axes (15, 16) spaced apart by a second distance less than the first distance; and pivotably mounting second and third transverse link members (7, 9) on the handle (2) at respective first ends thereof and pivotably attaching the second and third link members at respective second ends thereof to respective ones of said support arms (4, 5) at sixth and seventh pivot axes (13, 14) spaced apart by a third distance, said first, second, third, fourth, fifth, sixth and seventh axes being mutually parallel.

* * * * *